US006709231B2

(12) United States Patent
Schipani et al.

(10) Patent No.: US 6,709,231 B2
(45) Date of Patent: Mar. 23, 2004

(54) STATOR OF A VARIABLE-GEOMETRY AXIAL TURBINE FOR AERONAUTICAL APPLICATIONS

(75) Inventors: Claudia Schipani, Turin (IT); Ennio Spano, Turin (IT); Domenico Dalle Crode, Turin (IT)

(73) Assignee: Fiatavio S.p.A., Turin (IT)

( * ) Notice: Subject to any disclaimer, the term of this patent is extended or adjusted under 35 U.S.C. 154(b) by 0 days.

(21) Appl. No.: 10/063,766

(22) Filed: May 10, 2002

(65) Prior Publication Data

US 2003/0026693 A1 Feb. 6, 2003

(30) Foreign Application Priority Data

May 11, 2001 (IT) ..... TO2001A0445

(51) Int. Cl.[7] ..... F01D 17/16
(52) U.S. Cl. ..... 415/160
(58) Field of Search ..... 415/159, 160, 415/161, 162

(56) References Cited

U.S. PATENT DOCUMENTS 3,013,771 A * 12/1961 Henny ..... 415/160
3,224,194 A * 12/1965 De Feo et al. ..... 415/160
3,352,537 A * 11/1967 Petrie ..... 415/160
3,685,921 A * 8/1972 Dekeyser ..... 415/160
3,887,297 A * 6/1975 Welchek ..... 415/161
4,214,851 A * 7/1980 Tuley et al. ..... 415/159
4,278,398 A * 7/1981 Hull ..... 415/160
4,314,791 A * 2/1982 Weiler ..... 415/159
2002/0061249 A1 * 5/2002 Caubet et al. ..... 415/160

* cited by examiner

*Primary Examiner*—Christopher Verdier
(74) *Attorney, Agent, or Firm*—Howrey Simon Arnold & White LLP

(57) ABSTRACT

A stator of a variable-geometry axial turbine for aeronautical applications has an axis an is provided with an annular duct that has a diameter increasing along the axis, is delimited radially by an outer surface and by an inner surface and houses an array of air foil profiles; the profiles are rotatable relative to the outer and inner surfaces about respective axes of adjustment incident to the axis of the stator and each have an associated pair of end edges opposite each other and each slidably at a predetermined clearance from an associated shaped zone of the outer and inner surfaces, each shaped zone has a form complementary to an ideal surface generated by rotation of the associated end edges about the axis of adjustment so as to maintain a constant clearance between the profiles and the inner and outer surfaces.

9 Claims, 2 Drawing Sheets

STATOR OF A VARIABLE-GEOMETRY AXIAL TURBINE FOR AERONAUTICAL APPLICATIONS

CROSS REFERENCE TO RELATED APPLICATIONS

This Application claim priority under 35 U.S.C. §119 of Italian application number TO2001A 000445, filed May 11, 2001.

BACKGROUND OF INVENTION

This invention relates to a stator of a variable-geometry axial turbine for aeronautical applications and, in particular, for aeronautical engines.

As is known, an axial turbine for an aeronautical engine determines an annular duct with increasing diameter and comprises at least one stator and one rotor arranged axially in succession to each other, and comprising respective arrays of airfoil profiles housed in the annular duct and between them circumferentially delimiting associated spaces through which a flow of gas can pass.

In aeronautical engines, it has been found necessary to use axial turbines having the highest possible efficiency in all operating conditions and, therefore, over a relatively wide range of values for the rate of flow of the gases that pass through the turbine itself.

This requirement could be met by producing variable-geometry turbines, i.e. turbines comprising at least one stator in which, in use, it is possible to vary the transverse area of the associated spaces, in particular by adjusting the angular position of the airfoil profiles about respective axes incident to the axis of the turbine.

In stators of axial turbines of known type, the annular duct is delimited radially by conical surfaces while the airfoil profiles have a relatively long length in the direction of travel of the gases, because of which any displacement of these profiles would cause jamming against the above-mentioned conical surfaces or else excessive radial clearances and therefore considerable leakage of gas between adjacent spaces, because of which the flow of the gases in the spaces themselves would become non-uniform, with a consequent drastic reduction in the efficiency of the turbine.

SUMMARY OF INVENTION

The purpose of the invention is to produce a stator of a variable-geometry turbine for aeronautical applications, which enables the problems set out above to be solved simply and functionally.

According to the present invention, a stator of a variable-geometry axial turbine for aeronautical applications is produced; the stator having an axis and comprising an annular duct delimited radially by an annular outer and an annular inner surface; an array of airfoil profiles housed in the duct in positions angularly equidistant from each other about said axis and each comprising an associated pair of end edges opposite each other and coupled with said outer and inner surfaces, characterised in that said airfoil profiles are rotatable with respect to said outer and inner surfaces about respective axes of adjustment incident to said axis, and in that it comprises means for maintaining said airfoil profiles a predetermined clearance from said outer and inner surfaces to maintain a substantially constant clearance between said outer and inner surfaces and said end edges when the angular position of said airfoil profiles is varied.

BRIEF DESCRIPTION OF DRAWINGS

The invention will now be described with reference to the attached drawings, which show a non-limiting embodiment of the invention, in which.

DETAILED DESCRIPTION

Figure 1:
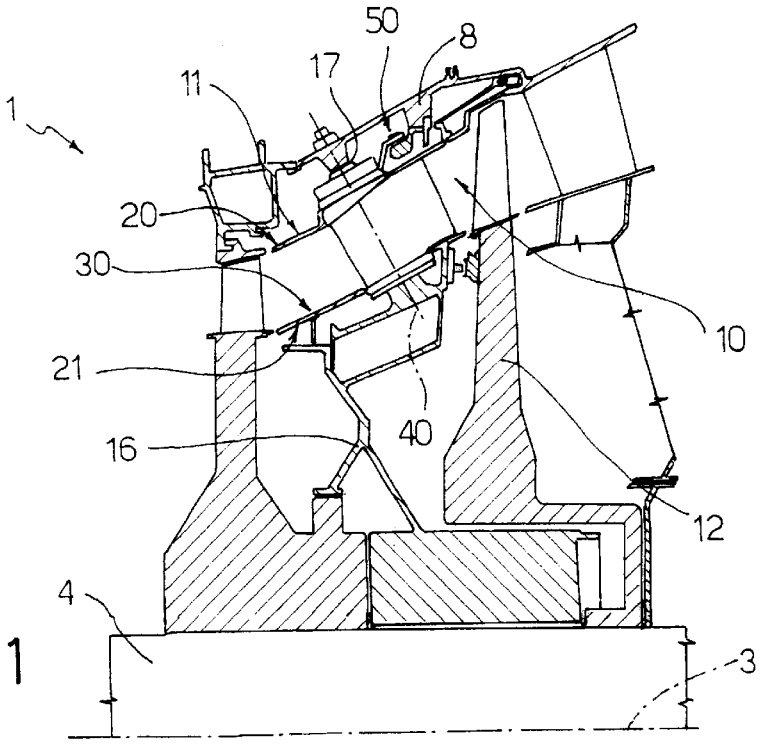
FIG. 1 is a schematic radial section of a preferred embodiment of the stator of a variable-geometry axial turbine for aeronautical applications, produced according to the invention.

In FIG. 1, the number 1 indicates a variable-geometry axial turbine (shown schematically and in part), which constitutes part of an aeronautical engine, not shown.

The turbine 1 is axially symmetrical with respect to an axis 3 coinciding with the axis of the associated aeronautical engine and comprises an engine shaft 4 rotatable about the axis 3 and a case or casing 8 housing a succession of coaxial stages, only one of which is shown as 10 in FIG. 1.

Figure 2:
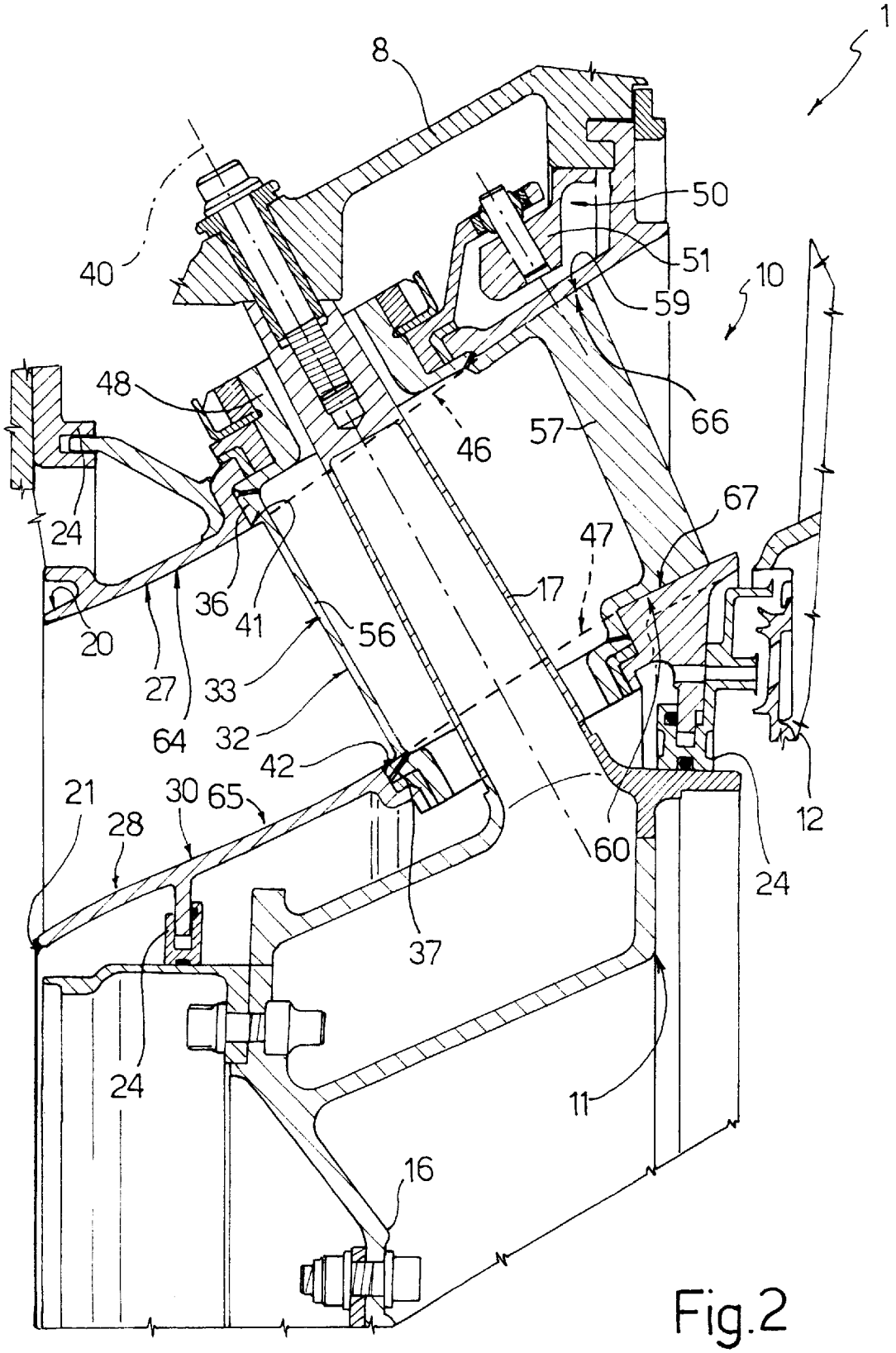
FIG. 2 shows, in radial section and at a larger scale, a detail of the stator in FIG. 1.

With reference to FIGS. 1 and 2, the stage 10 comprises a stator 11 and a rotor keyed to the engine shaft 4 downstream from the stator 11. The stator 11 in turn comprises a hub 16 (shown schematically and in part), which supports the engine shaft 4 in a known manner and is integrally connected to the casing 8 by means of a plurality of spokes 17 (FIG. 2) angularly equidistant from each other about the axis 3.

As shown in FIG. 2, the stator 11 also comprises two annular platforms or walls 20, 21, which are arranged in an intermediate radial position between the hub 16 and the casing 8, have the spokes 17 passing through them and are coupled, one with the casing 8 and the other with the hub 16 in substantially fixed datum positions by means for connecting devices 24 that allow the walls 20, 21 themselves the possibility of axial and radial displacements of relatively limited amplitude with respect to the casing 8 and the hub 16 in order to compensate, in service, for the differences in thermal expansion between the components.

The walls 20, 21 have respective surfaces 27, 28 facing each other and radially delimiting an annular duct 30 with a diameter increasing in the direction of travel of the gas flow.

Figure 3:
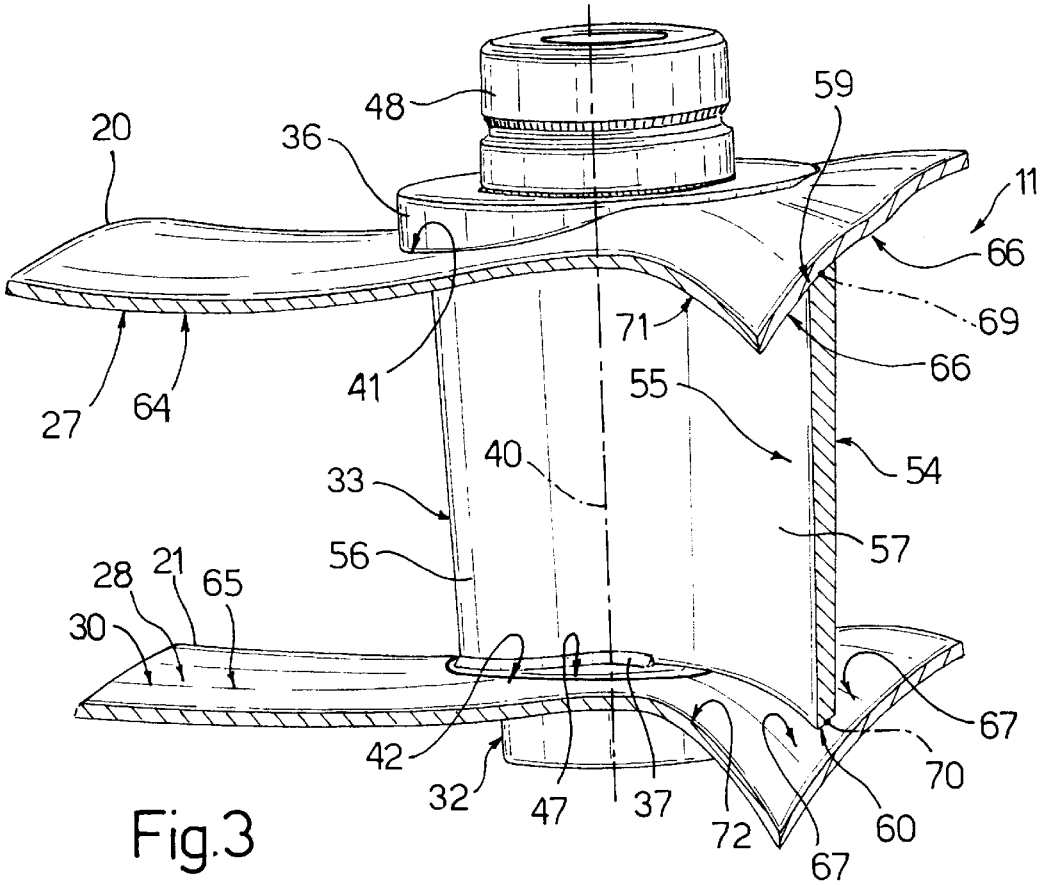
FIG. 3 is a perspective view, with parts cut away for clarity, of the detail in FIG. 2.

With reference to FIGS. 2 and 3, the walls 20, 21 carry an array of vanes 32 (only one of which is shown) angularly equidistant from each other about the axis 3 with the spokes 17 passing through them and comprising respective airfoil profiles 33, which are housed in the duct 30 and between them delimit circumferentially a plurality of spaces through which the gas flow passes (not shown in the attached figures).

Each vane 32 also comprises a pair of cylindrical tubular hinge flanges 36, 37 arranged at opposite ends of the associated profile 33 and coaxial with each other along an axis 40, which is incident to the axis 3 and substantially orthogonal to the surfaces 27, 28 so as to form an angle other than 90° with the axis 3.

The flanges 36, 37 of each vane 32 engage rotatably in respective circular seatings 41, 42 made in the walls 20 and 21 respectively to allow the associated profile 33 to rotate about the axis 40, project from the profile 33 radially with respect to the associated axis 40 and are delimited by respective surfaces 46 (FIG. 2) and 47, which are facing each other and extend with no break in continuity as a continuation of the surface 27 and the surface 28, respectively.

With reference to FIG. 2, the flange 36 of each vane 32 ends in a threaded cylindrical section 48 coaxial with the flange 36 itself and caused to rotate in use by an angular positioning unit 50 (partly shown) comprising in particular a motor-driven actuating and synchronising ring 51 designed to rotate the profiles 33 simultaneously about their respective axes 40 through the same angle, keeping the profiles 33 themselves in the same orientation to each other with respect to the surfaces 27, 28. In particular, the maximum angular deflection of each vane 32 about the associated axis 40 is approximately 6°.

With reference to FIG. 3, the profile 33 of each vane 32 is of known type, has a convex or dorsal surface 54 and a concave or ventral surface 55, and comprises a head portion 56 and a tapering tail portion 57, which define the leading edge and trailing edge respectively of the profile 33. The head portion 56 is integral with the two flanges 36, 37 while the tail portion 57 extends along the duct 30 beyond the flanges 36, 37 themselves.

In the tail portion 57, the dorsal face 54 and the ventral face 55 are connected to each other by two flat surfaces 59, 60 opposite each other, each of which is facing and at a predetermined clearance from an associated shaped zone 66, 67 of the surfaces 27, 28.

In fact, each surface 27, 28 has an associated conical zone 64, 65 that defines a mean course or path of the gases in the duct 30, while the zones 66, 67 have a shape complementary to respective ideal surfaces, which are defined by an envelope of the various angular positions assumed by the surfaces 59, 60 about the axis 40.

In the example described, these ideal surfaces are generated by the rotation about the axis 40 of datum lines 69, 70, which are situated on the surfaces 59 and 60 respectively, preferably in the median position between the ventral face 55 and the dorsal face 54. FIG. 3 shows in section a vane 33 in which only one associated point is shown for each of the median datum lines 69, 70.

Still with reference to the illustration in FIG. 3, in order to guide the gas flow progressively in the duct 30, the surfaces 27, 28 comprise, finally, respective pluralities of zones 71, 72, which gradually connect the zones 66, 67 to the associated conical zone 64, 65, while the surfaces 46, 47 are shaped according to the path followed by the surfaces 27, 28 to connect the edges delimiting the seatings 41, 42.

In use, it is possible to adjust the geometry or capacity of the spaces by simultaneously rotating the profiles 33 about their respective axes 40 by means of the unit 50. During this rotation, between the surfaces 59, 60 of each profile 33 and the associated zones 66, 67 of surfaces 27, 28, the radial clearance remains substantially constant for every angular position assumed by the profile 33 itself by reason of the special shaping of the zones 66, 67 themselves described above.

In particular, the height of the profiles 33 measured between the surfaces 59, 60 and the distance between the walls 20, 21 are calibrated in such a way that the surfaces 59, 60 co-operate with sliding against the zones 66, 67 of the surfaces 27, 28 with extremely limited radial clearance to ensure the fluid seal between vanes 33 and walls 20, 21 and, consequently, the uniformity of the flow of gas that passes through the stator spaces.

From the foregoing it is evident that the special shaping of the surfaces 27, 28 of the stator 10 allows relatively high efficiency levels of the stage 10 to be obtained for all angular positions of the vanes 32 and consequently for a relatively broad range of operating conditions of the turbine 1.

The situation just stated is due to the fact that the angular position of the profiles 33 can be adjusted and to the fact that the radial clearance between the profiles 33 and the walls 20, 21 is extremely limited and, above all, constant for all angular positions of the vanes 32 about their associated axes 40, even if the profiles 33 have a relatively long length in the direction of travel of the gases and the diameter of the duct 30 is increasing.

Consequently, in the stator 11 the substantially constant clearance and the continuous fluid seal between the vanes 32 and walls 20, 21 during adjustment not only prevents jamming or friction occurring between the vanes 32 themselves and the walls 20, 21 during adjustment, but above all prevents the formation of unwanted and unpredictable vortex wakes in the gas flow in the stator spaces due to leakage.

Moreover, the presence of the connecting zones 71, 72 and the special shaping of the vanes 32 and, in particular, the presence of the flanges 36, 37 enable the gas flow in the duct 30 to be guided in a gradual and optimum manner for all angular positions of the profiles 33 about their respective axes 40.

Finally, it is evident from the above that changes and variations can be made to the stator 11 described and illustrated, without extending it beyond the scope of protection of the present invention.

In particular, the surfaces 59, 60 could be shaped rather than flat and therefore the edges of the profiles 33 slidably at a predetermined clearance from the surfaces 27, 28 could also be defined by a line or a corner that extends from the hinge portions of the vane 32 as far as the trailing and/or leading edges.

Furthermore, the vanes 32 could be hinged to the walls 20, 21 or to other structures supporting the stator 11 in a manner different from the one illustrated and described, and/or could be driven in rotation by an angular positioning unit other than the unit 50 illustrated in part.

What is claimed is:

1. A stator (11) of a variable-geometry axial turbine (1) for aeronautical applications; the stator (11) having an axis (3) and comprising an annular duct (30) delimited radially by an annular outer surface (27) and by an annular inner surface (28); an array of airfoil profiles (33) housed in said duct (30), each airfoil profile (33) in a position angularly equidistant from an adjacent airfoil (33) profile about said axis (3) and each airfoil profile (33) comprising an associated pair of end edges (59, 60), wherein one end edge (59) is opposite the other end edge (60), and, wherein the end edges (59, 60) are a predetermined clearance from said outer and inner surfaces (27, 28); characterised in that said airfoil profiles (33) are rotatable with respect to said outer and inner surfaces (27, 28) about respective axes of adjustment (40) incident to said axis (3) and in that the airfoil profiles (33) comprise means for maintaining (66, 67) said airfoil profiles (33) a predetermined clearance from said outer and inner surfaces (27, 28) in order to maintain a substantially constant clearance between said outer and inner surfaces (27, 28) and said end edges (59, 60) when the angular position of said airfoil profiles (33) is varied.

2. The stator according to claim 1 characterised in that said means for maintaining (66, 67) comprise, for each said airfoil profile (33), a pair of shaped zones (66, 67) constituting a part of said outer and inner surfaces (27, 28) respectively and each having a form complementary to an ideal surface generated by rotation of said respective associated end edge (59, 60) about said respective axis of adjustment (40).

3. The stator according to claim 2 characterised in that each said airfoil profile (33) is delimited by a dorsal surface (54) and by a ventral surface (55) connected to each other by a pair of end surfaces (59, 60) defining said end edges; said ideal surfaces being generated by rotation about said axis of adjustment (40) of datum lines (69, 70) situated on said end surfaces (59, 60) in intermediate positions between said dorsal and ventral surfaces (54, 55).

4. The stator according to claim 2 characterised in that each said outer and inner surface (27, 28) comprises an associated conical zone (64, 65) and, for each said shaped zone (66, 67), an associated connecting zone (71, 72) between said conical zone (64, 65) and the shaped zone (66, 67) itself.

5. The stator according to claim 1 characterised in that each said airfoil profile (33) constitutes part of an associated vane (32) comprising two hinge portions (36, 37) extending from opposite ends of the airfoil profile (33) itself, coaxially with said associated axis of adjustment (14) and hinged to said outer (27) and inner (28) surfaces respectively.

6. The stator according to claim 5 characterised in that at least one of said hinge portions (36, 37) of each said vane (32) projects radially from said associated airfoil profile (33) with respect to said axis of adjustment (40) and is delimited by a guide surface (46, 47) extending as a continuation of said associated outer or inner surface (27, 28).

7. The stator according to claim 6 characterised in that said guide surfaces (46, 47) extend with no break in continuity as continuations of said associated outer and inner surfaces (27, 28).

8. The stator according to claim 6 characterised in that both said hinge portions (36, 37) of each said vane (32) are projecting and delimited by respective guide surfaces (46, 47) facing each other.

9. The stator according to claim 5 characterised in that each said airfoil profile (33) comprises a head portion (56) integral with said hinge portions (36, 37) and a tail portion (57) delimited by said end edges (59, 60).

* * * * *